US008305396B2

(12) United States Patent
Ahn et al.

(10) Patent No.: US 8,305,396 B2
(45) Date of Patent: Nov. 6, 2012

(54) METHOD AND APPARATUS FOR CORRECTING COLOR OF DISPLAY DEVICE

(75) Inventors: Ji Young Ahn, Gyeonggi-do (KR); Dong Woo Kang, Gyeonggi-do (KR); Ho Young Jung, Gyeonggi-do (KR)

(73) Assignee: LG Display Co., Ltd., Seoul (KR)

( * ) Notice: Subject to any disclaimer, the term of this patent is extended or adjusted under 35 U.S.C. 154(b) by 514 days.

(21) Appl. No.: 12/629,415

(22) Filed: Dec. 2, 2009

(65) Prior Publication Data

US 2010/0157150 A1 Jun. 24, 2010

(30) Foreign Application Priority Data

Dec. 23, 2008 (KR) ..... 10-2008-132367

(51) Int. Cl.
*G09G 5/02* (2006.01)

(52) U.S. Cl. ..... 345/604; 345/589
(58) Field of Classification Search ..... 345/589–605
See application file for complete search history.

(56) References Cited

U.S. PATENT DOCUMENTS 7,664,322 B1 * 2/2010 Wilensky ..... 382/181
7,945,111 B2 * 5/2011 Ishiga ..... 382/263

* cited by examiner

*Primary Examiner* — Xiao M. Wu
*Assistant Examiner* — Charles Tseng
(74) *Attorney, Agent, or Firm* — Morgan, Lewis & Bockius LLP

(57) ABSTRACT

In order to improve video quality by accurately detecting a preferred color region and correcting the preferred color region to a target color, a method for correcting a color of a display device includes converting input R/G/B data into Y/Cb/Cr data, calculating a weight by an exponential function using a dispersion and a distance between an input value and a target value of the Y/Cb/Cr data, comparing the calculated weight with a target color range so as to detect a target color region, and calculating a detection probability, detecting an average value, a minimum value and a maximum value of the Y/Cb/Cr data for the detected target color region from a previous frame, calculating a correction constant using the average value, the minimum value and the maximum value of the Y/Cb/Cr data, a predetermined target value of the Y/Cb/Cr data, and the Y/Cb/Cr which is detected as the target color region and is input, adding the detection probability to the calculated correction constant as the weight so as to calculate a correction amount, correcting the input Y/Cb/Cr data using the calculated correction amount so as to output the Y/Cb/Cr data, and inversely converting the corrected Y/Cb/Cr data into R/G/B data.

12 Claims, 3 Drawing Sheets

METHOD AND APPARATUS FOR CORRECTING COLOR OF DISPLAY DEVICE

This application claims the benefit of Korean Patent Application No. P2008-132367, filed on Dec. 23, 2008, which is hereby incorporated by reference as if fully set forth herein.

BACKGROUND OF THE INVENTION

1. Field of the Invention

The present invention relates to a display device, and more particularly, to a method and apparatus for correcting a color of the display device, which is capable of detecting a preferred color region from an input video and correcting the preferred color region to a target color.

2. Discussion of the Related Art

A video display device with high resolution and high definition has been developed according to a user's request. Most users store a color displayed on the video display device, such as a sky color, a grass color and a skin color, in their color storage spaces and determine the definition of an image based on a preferred color which has an influence on a color recognizing process. Accordingly, the video display device uses a preferred color correcting method for detecting a preferred color region from an input video and converting the detected preferred color region into a target color preferred by a user.

The preferred color correcting methods of the related art include a method of point-to-point matching a specific color and a color gamut correcting method using gamut variable adjustment. However, in the preferred color correcting methods of the related art, it is difficult to independently separate a color region to be corrected and to set a parameter for analyzing and correcting a frame. Accordingly, it is difficult to adaptively perform color detection and correction according to frames. In addition, video quality may deteriorate due to the correction of the gamut and contour noise may occur.

SUMMARY OF THE INVENTION

Accordingly, the present invention is directed to a method and apparatus for correcting a color of a display device that substantially obviates one or more problems due to limitations and disadvantages of the related art.

An object of the present invention is to provide a method and apparatus for correcting a color of a display device, which is capable of improving video quality by accurately detecting a preferred color region and correcting the preferred color region to a target color.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a method for correcting a color of a display device includes converting input R/G/B data into Y/Cb/Cr data; calculating a weight by an exponential function using a dispersion and a distance between an input value and a target value of the Y/Cb/Cr data, comparing the calculated weight with a target color range so as to detect a target color region, and calculating a detection probability; detecting an average value, a minimum value and a maximum value of the Y/Cb/Cr data for the detected target color region from a previous frame; calculating a correction constant using the average value, the minimum value and the maximum value of the Y/Cb/Cr data, a predetermined target value of the Y/Cb/Cr data, and the Y/Cb/Cr which is detected as the target color region and is input, adding the detection probability to the calculated correction constant as the weight so as to calculate a correction amount, correcting the input Y/Cb/Cr data using the calculated correction amount so as to output the Y/Cb/Cr data; and inversely converting the corrected Y/Cb/Cr data into R/G/B data.

In another aspect of the present invention, an apparatus for correcting a color of a display device includes a color space converter converting input R/G/B data into Y/Cb/Cr data; a target color region detector calculating a weight by an exponential function using a dispersion and distance between an input value and a target value of the Y/Cb/Cr data, comparing the calculated weight with a target color range to detect a target color region, and calculating a detection probability; a detection region analyzer detecting an average value, a minimum value and a maximum value of the Y/Cb/Cr data of the target color region detected by the target color region detector from a previous frame; a target color corrector calculating a correction constant using the average value, the minimum value and the maximum value of the Y/Cb/Cr data from the detection region analyzer, a predetermined target value of the Y/Cb/Cr data, and the Y/Cb/Cr data which is detected as the target color region and is input from the target color detector, adding the detection probability to the calculated correction constant as the weight so as to calculate a correction amount, and correcting the input Y/Cb/Cr data using the calculated correction amount so as to output the corrected Y/Cb/Cr data; and a color space inverse converter inversely converting the corrected Y/Cb/Cr data from the target color corrector into R/G/B data.

It is to be understood that both the foregoing general description and the following detailed description of the present invention are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this application, illustrate embodiment(s) of the invention and together with the description serve to explain the principle of the invention. In the drawings.

DETAILED DESCRIPTION OF THE INVENTION

Reference will now be made in detail to the preferred embodiments of the present invention, examples of which are illustrated in the accompanying drawings. Wherever possible, the same reference numbers will be used throughout the drawings to refer to the same or like parts.

Figure 1:
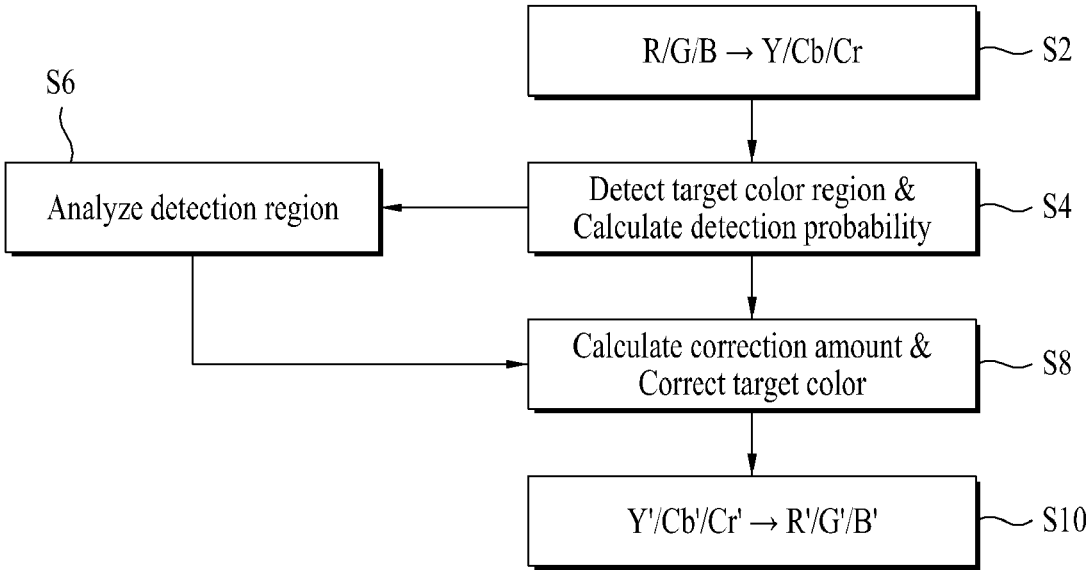
FIG. 1 is a flowchart illustrating a method for correcting a color of a display device according to an embodiment of the present invention.

FIG. 1 is a flowchart illustrating a method for correcting a color of a display device according to an embodiment of the present invention.

In a step 2 (S2), input R/G/B data is converted into Y/Cb/Cr data using Equation 1. Y denotes a luminance component, Cb and Cr denote color difference components. In detail, Cb denotes a color difference component of B-Y and Cr denotes a color difference component of R-Y.

$$Y=0.299R+0.589G+0.114B$$

$$Cb=0.564(B-Y)=0.16874R-0.33126G+0.5B$$

$$Cr=0.713(R-Y)=0.5R-0.41869G-0.08131B \quad \text{[Equation 1]}$$

In a step 4 (S4), a weight g is calculated using a detection function of a target color region according to a dispersion and a distance between an input value and a predetermined target value of the Y/Cb/Cr data, the calculated weight g is compared with a predetermined detection color range (σY/σCb/σCr) so as to detect the target color region, and a detection probability $P_{det}$ is calculated using the calculated weight g. Since the detection function of the target color region calculates the weight by an exponential function (exp) using the dispersion and the distance between the input value and the target value of the Y/Cb/Cr data as shown in Equation 2, it is possible to improve detection accuracy with low time complexity of the color detection.

$$g = -\left[\left(\frac{Y-Y_m}{\sigma Y}\right)^2 + \left(\frac{Cb-Cb_m}{\sigma Cb}\right)^2 + \left(\frac{Cr-Cr_m}{\sigma Cr}\right)^2\right] \quad \text{[Equation 2]}$$

$$P_{det} = \exp(g)$$

In Equation 2, $Y_m$, $Cb_m$ and $Cr_m$ respectively denote intermediate values of the predetermined target colors, and σY, σCb and σCr respectively denote predetermined weight parameters, which set detection color ranges of a three-dimensional space. The detection probability $P_{det}$ indicates how close the detection data is to the target color are and is used to determine a correction amount for correcting the detection data to the target color after this step.

In a step 6 (S6), pixels which are detected from one frame as the target color region in the step 4 (S4) are analyzed, and an average value (avg), a minimum value (min), and a maximum value (max) of the Y/Cb/Cr data in the detection region are detected. At this time, in order to prevent video delay, an average value (avg), a minimum value (min) and a maximum value (max) of the Y/Cb/Cr data for the pixels which are detected from a previous frame as the target color region are detected.

In a step 8 (S8), a correction constant Δ is calculated using the Y/Cb/Cr data which is detected as the target color region and is input in the step 4 (S4) and the average value (avg), the minimum value (min), and the maximum value (max) of the Y/Cb/Cr data detected in the step 6 (S6). A correction amount of the Y/Cb/Cr data is determined by a product of the correction constant Δ calculated with respect to the Y/Cb/Cr data, the detection probability $P_{det}$ calculated in the step 4 (S4) and a predetermined gamut correction weight K according to the characteristics of the frames, and the determined correction amount is added to the input Y/Cb/Cr data such that Y'/Cb'/Cr' data corrected to the target color is calculated. An algorithm for determining the correction amount in order to maintain continuous gradation of the video when the preferred color is corrected is of importance. Therefore, when the correction amount is calculated, the average value (avg) of the correction target color detected from the video of one frame is used, and the input Y/Cb/Cr data is mean-shifted using the average value (avg) according to the detection probability $P_{det}$ so as to be corrected to the target color. In detail, a method for calculating the correction amount of the Y/Cb/Cr data is as follows.

First, in order to minimize contour noise in a boundary of the target color region, a primary correction constant is calculated according to the average value (avg) and the correction target value (target) of the Y/Cb/Cr data detected from the previous frame. If the average value (avg) of the Y/Cb/Cr data detected from the previous frame is smaller than the correction target value (target), the primary correction constant (slope) is calculated using Equation 3 and, if the average value (avg) is larger than or equal to the target value (target), the primary correction constant (slope) is calculated using Equation 4.

$$\text{slope} = \frac{avg - \min}{\text{target} - \min} \quad \text{[Equation 3]}$$

$$\text{slope} = \frac{avg - \max}{\text{target} - \max} \quad \text{[Equation 4]}$$

In other words, if the average value (avg) of the Y/Cb/Cr data detected from the previous frame is smaller than the correction target value (target), the primary correction constant (slope) is calculated by a ratio of a difference between the average value (avg) and the minimum value (min) to a difference between the target value (target) and the minimum value as shown in Equation 3. In contrast, if the average value (avg) of the Y/Cb/Cr data detected from the previous frame is larger than or equal to the correction target value (target), the primary correction constant (slope) is calculated by a ratio of a difference between the average value (avg) and the maximum value (max) to the target value (target) and the maximum value (max) as shown in Equation 4.

Subsequently, a secondary correction constant Δ with continuity is calculated according to the primary correction constant (slope), and the minimum value (min), the maximum value (max) and the average value (avg) of the Y/Cb/Cr data detected from the previous frame. If the input value (input) of the Y/Cb/Cr data is smaller than the average value (avg), the secondary correction constant Δ is calculated using Equation 5 and, if the input value (input) is larger than or equal to the average value (avg), the secondary correction constant Δ is calculated using Equation 6.

$$\Delta = \frac{\text{slopes} \times (\text{target} - avg) \times (\text{input} - \min)}{(avg - \min)} \quad \text{[Equation 5]}$$

$$\Delta = \frac{\text{slopes} \times (\text{target} - avg) \times (1 + (\text{input} - avg))}{(avg - \max)} \quad \text{[Equation 6]}$$

Next, the correction amount $\Delta \times R_{det}$ is determined using the detection probability $P_{det}$ indicating how close the detected Y/Cb/Cr data is to the target color as an additional correction constant, the determined correction amount $\Delta \times R_{det}$ is added to the input value (input) of the Y/Cb/Cr data as shown in Equation 7 so as to calculate an output value (output) of the corrected Y'/Cb'/Cr'. In addition, the correction amount can be adjusted according to the frames by changing the gamut correction weight K according to the characteristics of the frames.

$$\text{output}=\text{input}+\Delta\times P_{det}\times K \quad \text{Equation 7}$$

In a step 10 (S10), the corrected Y'/Cb'/Cr' data calculated in the step 8 (S8) is inversely converted into corrected R'/G'/B' data. The corrected Y'/Cb'/Cr' data is inversely converted into the corrected R'/G'/B' data using Equation 8.

$$R'=Y'+1.402Cr'$$

$$G'=Y'-0.334Cb'-0.713Cr'$$

$$B'=Y'+1.772Cr' \quad \text{[Equation 8]}$$

Figure 2:
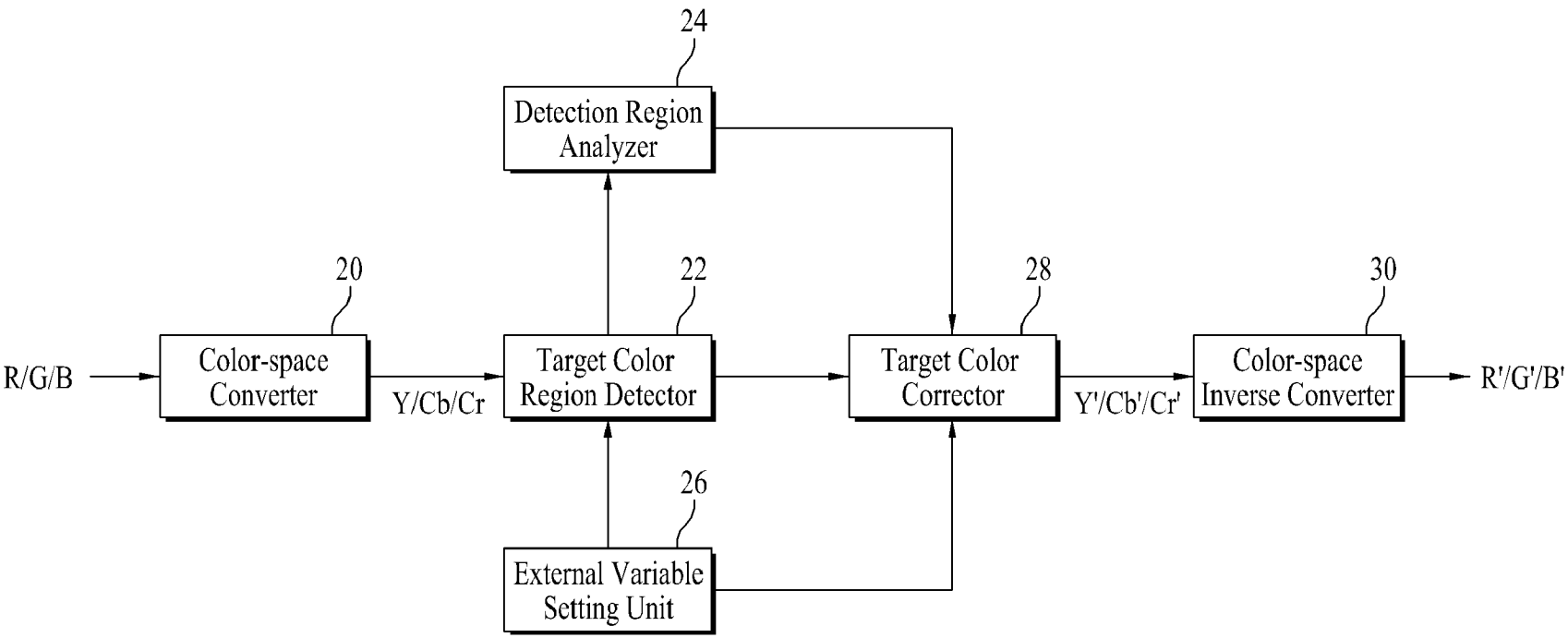
FIG. 2 is a block diagram showing an apparatus for correcting a color of a display device according to an embodiment of the present invention.

FIG. 2 is a block diagram showing an apparatus for correcting a color of a display device according to an embodiment of the present invention.

The color correcting apparatus shown in FIG. 2 includes a color space converter 20, a target color region detector 22, a detection region analyzer 24, an external variable setting unit 26, a target color corrector 28, and a color space inverse converter 30.

The color space converter 20 converts input R/G/B data into Y/Cb/Cr data and outputs the Y/Cb/Cr data.

The target color region detector 22 applies a detection function to the Y/Cb/Cr data from the color space converter 20 so as to calculate a weight (g), compares the calculated weight (g) with a target color range σY/σCb/σCr so as to detect a target color region, and calculates a detection probability $P_{det}$ using the calculated weight (g). The detection function calculates the weight (g) by an exponential function (exp) using a dispersion and a distance between an input value and a target value of the Y/Cb/Cr data by the operation of Equation 2 as described above, the calculated weight (g) is compared with the target color range σY/σCb/σCr so as to detect the target color region, and the detection probability $P_{det}$ is calculated using the calculated weight g. Here, the weight parameter σY/σCb/σCr for setting the target color range and the intermediate value $Y_m/Cb_m/Cr_m$ of the target value are previously set by a designer, are stored in the external variable setting unit 26, and are supplied from the external variable setting unit 26. The target color region detector 22 outputs the Y/Cb/Cr data to the target color corrector 28 when the input Y/Cb/Cr data is detected as the target color region and outputs the Y/Cb/Cr data to the color space inverse converter 30 when the input Y/Cb/Cr data is not detected as the target color region.

The detection region analyzer 24 analyzes data of pixels detected as the target color region by the target color region detector 22, and detects and supplies an average value (avg), a minimum value (min), and a maximum value (max) of the Y/Cb/Cr data of the detection region to the target color corrector 28. At this time, in order to prevent video delay, an average value (avg), a minimum value (min) and a maximum value (max) of the Y/Cb/Cr data for the pixels which are detected from a previous frame as the target color region are detected.

The target color corrector 28 calculates a correction constant Δ using the Y/Cb/Cr data which is detected as the target color region and is input from the target color region detector 22, and the average value (avg), the minimum value (min), and the maximum value (max) of the Y/Cb/Cr data from the detection region analyzer 24. A correction amount of the input Y/Cb/Cr data is determined by a product of the correction constant Δ calculated with respect to the input Y/Cb/Cr data, the detection probability $P_{det}$ from the target color region detector 22, and a predetermined gamut correction weight K according to the characteristics of the frames, and the determined correction amount is added to the input Y/Cb/Cr data such that the input Y/Cb/Cr data is corrected to the target color, the corrected Y'/Cb'/Cr' data is supplied to the color space inverse converter 30. In detail, the target color corrector 28 calculates a primary correction constant (slope) according to the average value (avg), the minimum value (min) and the maximum value (max) of the Y/Cb/Cr data of the previous frame detected by the detection region analyzer 24 and the correction target value (target) (see Equations 3 and 4). The correction target value (target) of the Y/Cb/Cr data is previously set by a designer, is stored in the external variable setting unit 26, and is supplied from the external variable setting unit 26. Subsequently, a secondary correction constant Δ having continuity is calculated according to the calculated primary correction constant (slope), and the input value (input), the target value (target), the minimum value (min), the maximum value (max), and the average value (avg) of the Y/Cb/Cr data (see Equations 5 and 6). Next, the correction amount is determined by the operation of the secondary correction constant Δ×the detection probability $P_{det}$×the gamut correction weight K according to the frames, the determined correction amount is added to the input Y/Cb/Cr data so as to correct the input Y/Cb/Cr data to the target color (see Equation 7), and the corrected Y'/Cb'/Cr' data is supplied to the color space inverse converter 30. The gamut correction weight K according to the frames is previously set by the designer, is stored in the external variable setting unit 26, and is supplied from the external variable setting unit 26.

The color space inverse converter 30 inversely converts the corrected Y'/Cb'/Cr' data output from the target color corrector 28 into R'/G'/B' data and outputs the R'/G'/B' data. In addition, the color space inverse converter 30 inversely converts the Y/Cb/Cr data, which is not detected as the target color region and is input from the target color region detector 22, into R/G/B data and outputs the R/G/B data.

Since the method and apparatus for correcting the color of the display device according to the present invention calculates the weight by the exponential function using the dispersion and the distance between the input value and the target value and detects the correction region, it is possible to improve accuracy while the target color region to be corrected to the target color is easily detected. Contour noise can be decreased by calculating the primary correction constant according to the target value using the average value of the target color region detected from the previous frame, calculating the secondary correction constant according to the calculated primary correction constant and the average value, the minimum value and the maximum value, and determining the correction amount of the input data. The contour noise can be further decreased by calculating the detection probability that the input data is the target color to be detected when the target color region is detected and using the detection probability as the correction amount for adjusting the correction amount.

Figure 3:
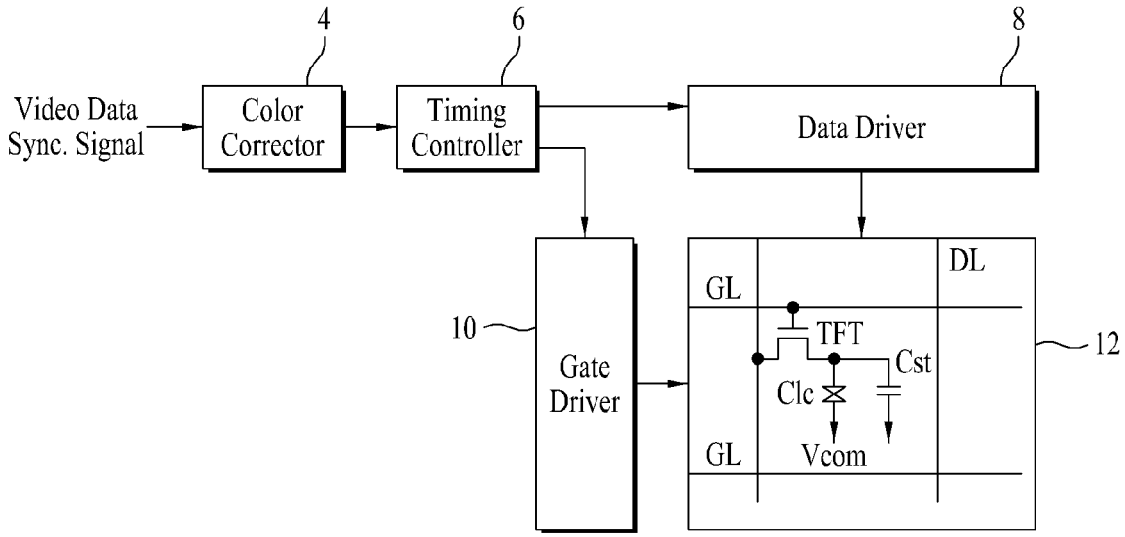
FIG. 3 is a block diagram showing a liquid crystal display device using the apparatus for correcting the color according to the embodiment of the present invention.

FIG. 3 is a block diagram showing a liquid crystal display device using the apparatus for correcting the color according to the embodiment of the present invention.

The liquid crystal display device shown in FIG. 3 includes a liquid crystal panel 12, a data driver 8 for driving data lines DL of the liquid crystal panel 12, a gate driver 10 for driving gate lines GL of the liquid crystal panel 12, a color corrector 4 for detecting a target color region from input data, correcting the target color region to a target color, and outputting the target color, and a timing controller 6 for aligning video data from the color corrector 4, supplying the aligned video data to the data driver 8, and controlling the data driver 8 and the gate driver 10.

As described above with reference to FIGS. 1 and 2, the color corrector 4 converts R/G/B data into Y/Cb/Cr data so as to detect a target color region, corrects the Y/Cb/Cr data of the detected target color region to a target value, inversely converts the corrected Y'/Cb'/Cr' data to R'/G'/B' data, and outputs the R'/G'/B' to the timing controller 6. Since the color corrector 4 calculates a weight by an exponential function using a dispersion and a distance between an input value and a target value of the Y/Cb/Cr data so as to detect a correction region, it is possible to improve accuracy while a target color region to be corrected to a target color is easily detected. Contour noise can be decreased by calculating the primary correction constant according to the target value using the average value of the target color region detected from the previous frame, calculating the secondary correction constant according to the calculated primary correction constant and the average value, the minimum value and the maximum value, and determining the correction amount of the input data. The contour noise can be further decreased by calculating the detection probability that the input data is the target color to be detected when the target color region is detected and using the detection probability as the correction amount for adjusting the correction amount. The color correcting unit 4 outputs the input data, which is not detected as the target color region, to the timing controller 6, without correcting the color.

The timing controller 6 aligns the data output from the color corrector 4 and outputs the aligned data to the data driver 8. The timing controller 6 generates a data control signal for controlling the driving timing of the data driver 8 and a gate control signal for controlling the driving timing of the gate driver 10 using a plurality of synchronization signals from the color corrector 4, that is, a dot clock, a data enable signal, a horizontal synchronization signal and a vertical synchronization signal, and outputs the data control signal and the gate control signal.

The data driver 8 converts digital video data from the timing controller 6 into an analog data signal (pixel voltage signal) using a gamma voltage in response to the data control signal from the timing controller 6, and supplies the analog data signal to the data lines DL of the liquid crystal panel 12.

The gate driver 10 sequentially drives the gate lines GL of the liquid crystal panel 12 in response to the gate control signal of the timing controller 6.

The liquid crystal panel 12 displays a video via a pixel matrix in which a plurality of pixels are arranged. Each of the pixels reproduces a desired color by a combination of sub-pixels of red, green and blue for adjusting light transmissivity by varying the arrangement of the liquid crystal according to the data signal. Each of the sub-pixels includes a thin-film transistor (TFT) connected with each of the gate lines GL and each of the data lines DL, a liquid crystal capacitor Clc connected to the TFT in parallel, and a storage capacitor Cst. The liquid crystal capacitor Clc charges a difference voltage between the data signal supplied to a pixel electrode via the TFT and a common voltage Vcom supplied to a common electrode and drives the liquid crystal according to the charged voltage, thereby adjusting light transmissivity. The storage capacitor Cst stably holds the voltage charged in the liquid crystal capacitor Clc. The liquid crystal panel 12 displays a video, of which the color is corrected to a target color preferred by a person using the color correcting unit 4, with excellent video quality.

Since the method and apparatus for correcting the color of the display device according to the present invention calculates the weight by the exponential function using the dispersion and the distance between the input value and the target value and detects the correction region, it is possible to improve accuracy while the target color region to be corrected to the target color is easily detected.

In addition, contour noise can be decreased by calculating the primary correction constant according to the target value using the average value of the target color region detected from the previous frame, calculating the secondary correction constant according to the calculated primary correction constant and the average value, the minimum value and the maximum value, and determining the correction amount of the input data. The contour noise can be further decreased by calculating the detection probability that the input data is the target color to be detected when the target color region is detected and using the detection probability as the correction amount for adjusting the correction amount.

As a result, the method and apparatus for correcting the color of the display device according to the present invention can reduce the deterioration of a specific color range, due to the decrease of a CIE-XYZ ratio of pure colors RGB to full white, which is generated when a specific model with low power consumption and high luminance is developed. For reproduction of a preferred color, a preferred color region of an input video is detected based on a target Y/Cb/Cr value of a light blue color, a green color and a skin color and is corrected to a target Y/Cb/Cr value, and the corrected value is output. In addition, a visible color temperature difference can be variously set by simply changing a parameter by a color detecting and correcting unit, and, if the number of distorted regions is large, independent correction is possible according to regions within a display color gamut.

It will be apparent to those skilled in the art that various modifications and variations can be made in the present invention without departing from the spirit or scope of the invention. Thus, it is intended that the present invention covers the modifications and variations of this invention provided they come within the scope of the appended claims and their equivalents.

What is claimed is:

1. A method for correcting a color of a display device, the method comprising:

converting input R/G/B data into Y/Cb/Cr data;

calculating a weight by an exponential function using a dispersion and a distance between an input value and a target value of the Y/Cb/Cr data, comparing the calculated weight with a target color range so as to detect a target color region, and calculating a detection probability;

detecting an average value, a minimum value and a maximum value of the Y/Cb/Cr data for the detected target color region from a previous frame;

calculating a correction constant using the average value, the minimum value and the maximum value of the Y/Cb/Cr data, a predetermined target value of the Y/Cb/Cr data, and the Y/Cb/Cr data which is detected as the target color region and is input, adding the detection probability to the calculated correction constant as the weight so as to calculate a correction amount, correcting the input Y/Cb/Cr data using the calculated correction amount so as to output the Y/Cb/Cr data;

inversely converting the corrected Y/Cb/Cr data into R/G/B data; and displaying the converted R/G/B data on the display device.

2. The method according to claim 1, wherein the detection probability is calculated by the following equation:

$$g = -\left[\left(\frac{Y - Y_m}{\sigma Y}\right)^2 + \left(\frac{Cb - Cb_m}{\sigma Cb}\right)^2 + \left(\frac{Cr - Cr_m}{\sigma Cr}\right)^2\right]$$

$$P_{det} = \exp(g)$$

(where, Y, Cb and Cr denote input data, $Y_m$, $Cb_m$ and $Cr_m$ are intermediate values of predetermined target colors, and σY, σCb and σCr are predetermined weight parameters).

3. The method according to claim 2, wherein the calculating of the correction constant includes:

calculating a primary correction constant (slope) using the following equation:

$$\text{slope} = \frac{avg - \min}{\text{target} - \min}$$

using the average value (avg), the minimum value (min), the maximum value (max) of the Y/Cb/Cr data if the average value (avg) of the Y/Cb/Cr data is smaller than a correction target value (target), or calculating the primary correction constant (slope) using the following equation:

$$\text{slope} = \frac{avg - \max}{\text{target} - \max}$$

if the average value (avg) is larger than or equal to the target value (target), and calculating a secondary correction constant Δ using the following equation:

$$\Delta = \frac{\text{slopes} \times (\text{target} - avg) \times (\text{input} - \min)}{(avg - \min)}$$

using the primary correction constant (slope), the minimum value (min), the maximum value (max), the average value (avg), and the target value (target) if the input value (input) of the Y/Cb/Cr data is smaller than the average value (avg), or calculating the secondary correction constant Δ using the following equation:

$$\Delta = \frac{\text{slopes} \times (\text{target} - avg) \times (1 + (\text{input} - avg))}{(avg - \max)}$$

if the input value (input) is larger than or equal to the average value (avg).

4. The method according to claim 3, wherein:

the correction amount is calculated by a product of the secondary correction constant Δ and the detection probability $P_{det}$, and the correction amount is adjusted according to a predetermined gamut correction weight K according to frames.

5. An apparatus for correcting a color to be displayed, the apparatus comprising:

a display panel;

a color space converter converting input R/G/B data into Y/Cb/Cr data;

a target color region detector calculating a weight by an exponential function using a dispersion and distance between an input value and a target value of the Y/Cb/Cr data, comparing the calculated weight with a target color range to detect a target color region, and calculating a detection probability;

a detection region analyzer detecting an average value, a minimum value and a maximum value of the Y/Cb/Cr data of the target color region detected by the target color region detector from a previous frame;

a target color corrector calculating a correction constant using the average value, the minimum value and the maximum value of the Y/Cb/Cr data from the detection region analyzer, a predetermined target value of the Y/Cb/Cr data, and the Y/Cb/Cr data which is detected as the target color region and is input from the target color detector, adding the detection probability to the calculated correction constant as the weight so as to calculate a correction amount, and correcting the input Y/Cb/Cr data using the calculated correction amount so as to output the corrected Y/Cb/Cr data; and a color space inverse converter inversely converting the corrected Y/Cb/Cr data from the target color corrector into R/G/B data to be displayed on the display panel.

6. The apparatus according to claim 5, wherein the target color region detector calculates the detection probability using the following equation:

$$g = -\left[\left(\frac{Y - Y_m}{\sigma Y}\right)^2 + \left(\frac{Cb - Cb_m}{\sigma Cb}\right)^2 + \left(\frac{Cr - Cr_m}{\sigma Cr}\right)^2\right]$$

$$P_{det} = \exp(g)$$

(where, Y, Cb and Cr denote input data, $Y_m$, $Cb_m$ and $Cr_m$ are intermediate values of predetermined target colors, and σY, σCb and σCr are predetermined weight parameters).

7. The apparatus according to claim 6, wherein the target color corrector:

calculates a primary correction constant (slope) using the following equation:

$$\text{slope} = \frac{avg - \min}{\text{target} - \min}$$

using the average value (avg), the minimum value (min), the maximum value (max) of the Y/Cb/Cr data if the average value (avg) of the Y/Cb/Cr data is smaller than a correction target value (target), or calculates the primary correction constant (slope) using the following equation:

$$\text{slope} = \frac{avg - \max}{\text{target} - \max}$$

if the average value (avg) is larger than or equal to the target value (target), and calculates a secondary correction constant Δ using the following equation:

$$\Delta = \frac{\text{slopes} \times (\text{target} - avg) \times (\text{input} - \text{min})}{(avg - \text{min})}$$

using the primary correction constant (slope), the minimum value (min), the maximum value (max), the average value (avg), and the target value (target), or calculates the secondary correction constant Δ using the following equation:

$$\Delta = \frac{\text{slopes} \times (\text{target} - avg) \times (1 + (\text{input} - avg))}{(avg - \text{max})}$$

if the input value (input) is larger than or equal to the average value (avg).

8. The apparatus according to claim 7, wherein the target color corrector calculates the correction amount by a product of the secondary correction constant Δ and the detection probability $P_{det}$ and adjusts the correction amount according to a predetermined gamut correction weight K according to frames.

9. A liquid crystal display device, comprising:

a color space converter converting input R/G/B data into Y/Cb/Cr data;

a target color region detector calculating a weight by an exponential function using a dispersion and distance between an input value and a target value of the Y/Cb/Cr data, comparing the calculated weight with a target color range to detect a target color region, and calculating a detection probability;

a detection region analyzer detecting an average value, a minimum value and a maximum value of the Y/Cb/Cr data of the target color region detected by the target color region detector from a previous frame;

a target color corrector calculating a correction constant using the average value, the minimum value and the maximum value of the Y/Cb/Cr data from the detection region analyzer, a predetermined target value of the Y/Cb/Cr data, and the Y/Cb/Cr data which is detected as the target color region and is input from the target color detector, adding the detection probability to the calculated correction constant as the weight so as to calculate a correction amount, and correcting the input Y/Cb/Cr data using the calculated correction amount so as to output the corrected Y/Cb/Cr data;

a color space inverse converter inversely converting the corrected Y/Cb/Cr data from the target color corrector into R/G/B data; and a liquid crystal display panel displaying the output data from the color space inverse converter.

10. The device according to claim 9, wherein the target color region detector calculates the detection probability using the following equation:

$$g = -\left[\left(\frac{Y - Y_m}{\sigma Y}\right)^2 + \left(\frac{Cb - Cb_m}{\sigma Cb}\right)^2 + \left(\frac{Cr - Cr_m}{\sigma Cr}\right)^2\right]$$

$$P_{det} = \exp(g)$$

(where, Y, Cb and Cr denote input data, $Y_m$, $Cb_m$ and $Cr_m$ are intermediate values of predetermined target colors, and σY, σCb and σCr are predetermined weight parameters).

11. The device according to claim 10, wherein the target color corrector:

calculates a primary correction constant (slope) using the following equation:

$$\text{slope} = \frac{avg - \text{min}}{\text{target} - \text{min}}$$

using the average value (avg), the minimum value (min), the maximum value (max) of the Y/Cb/Cr data if the average value (avg) of the Y/Cb/Cr data is smaller than a correction target value (target), or calculates the primary correction constant (slope) using the following equation:

$$\text{slope} = \frac{avg - \text{max}}{\text{target} - \text{max}}$$

if the average value (avg) is larger than or equal to the target value (target), and calculates a secondary correction constant Δ using the following equation:

$$\Delta = \frac{\text{slopes} \times (\text{target} - avg) \times (\text{input} - \text{min})}{(avg - \text{min})}$$

using the primary correction constant (slope), the minimum value (min), the maximum value (max), the average value (avg), and the target value (target), or calculates the secondary correction constant Δ using the following equation:

$$\Delta = \frac{\text{slopes} \times (\text{target} - avg) \times (1 + (\text{input} - avg))}{(avg - \text{max})}$$

if the input value (input) is larger than or equal to the average value (avg).

12. The device according to claim 11, wherein the target color corrector calculates the correction amount by a product of the secondary correction constant Δ and the detection probability $P_{det}$ and adjusts the correction amount according to a predetermined gamut correction weight K according to frames.

* * * * *